US012167764B2

(12) United States Patent
Otto et al.

(10) Patent No.: US 12,167,764 B2
(45) Date of Patent: Dec. 17, 2024

(54) PROTECTIVE LINER FOR HEADWEAR

(71) Applicant: Wilson Sporting Goods Co., Chicago, IL (US)

(72) Inventors: Samuel J. Otto, Hermosa Beach, CA (US); Andrew K. Tryner, Chicago, IL (US); Matthew J. Dierkes, Chicago, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 21 days.

(21) Appl. No.: 17/507,371

(22) Filed: Oct. 21, 2021

(65) Prior Publication Data

US 2023/0127294 A1 Apr. 27, 2023

(51) Int. Cl.

| | |
|---|---|
| ***A42B 1/0189*** | (2021.01) |
| ***A42B 1/019*** | (2021.01) |
| ***A42B 1/08*** | (2006.01) |
| ***A63B 71/08*** | (2006.01) |
| *A63B 71/10* | (2006.01) |

(52) U.S. Cl.

CPC ..... *A42B 1/0189* (2021.01); *A42B 1/019* (2021.01); *A42B 1/08* (2013.01); *A63B 71/081* (2013.01); *A63B 71/10* (2013.01)

(58) Field of Classification Search

CPC ..... A42B 1/0189; A42B 1/08; A42B 1/019; A42B 3/127; A42B 3/125; A42B 3/121; A42B 3/12; A63B 71/10; A63B 71/081; A42C 5/02; A42C 5/04

USPC ..... 2/181–182.2

See application file for complete search history.

(56) References Cited

U.S. PATENT DOCUMENTS

| | | | | |
|---|---|---|---|---|
| 1,251,107 | A * | 12/1917 | Rodgers | A42B 1/0189 2/200.3 |
| 2,309,476 | A | 1/1943 | Patterson, Jr. | |
| 2,740,567 | A * | 4/1956 | Kaufman | A42B 1/0192 206/8 |
| 3,557,156 | A | 1/1971 | Enneper et al. | |
| 3,890,649 | A | 6/1975 | Diggins | |
| 3,900,024 | A | 8/1975 | Lauber et al. | |
| 3,923,049 | A | 12/1975 | Lauber et al. | |
| 4,051,553 | A | 10/1977 | Howard | |
| 4,235,228 | A | 11/1980 | Gaylord et al. | |
| 4,279,344 | A | 7/1981 | Holloway, Jr. | |
| 4,295,229 | A | 10/1981 | Clark et al. | |
| 4,301,564 | A | 11/1981 | Dalebout | |
| 4,400,829 | A | 8/1983 | Willis | |
| 4,411,262 | A | 10/1983 | von Bonin et al. | |
| 4,427,002 | A | 1/1984 | Baron et al. | |

(Continued)

FOREIGN PATENT DOCUMENTS

| | | |
|---|---|---|
| GB | 2055582 | 3/1981 |
| GB | 2200286 | 8/1988 |

*Primary Examiner* — Amy Vanatta

(74) *Attorney, Agent, or Firm* — Terence P. O'Brien; Todd A. Rothe

(57) ABSTRACT

A protective headwear liner may include an encasement and a moldable and hardenable material within the encasement. The encasement is deformable to a U-shape while containing the material prior to hardening of the material. The U-shape may have a flat front and two flat sides corresponding to a front and sides of a person's head, respectively, wherein the two flat sides are joined to the flat front by curves. The material is configured to retain the U-shape following hardening of the material.

20 Claims, 8 Drawing Sheets

(56) References Cited

U.S. PATENT DOCUMENTS 4,428,089 A 1/1984 Dawber et al.
4,433,494 A 2/1984 Courvoisier et al.
4,433,680 A 2/1984 Yoon
4,442,833 A 4/1984 Dahlen et al.
4,484,360 A 11/1984 Leighton et al.
4,502,479 A 3/1985 Garwood et al.
4,559,646 A 12/1985 Ertl
4,570,622 A 2/1986 von Bonin et al.
4,572,171 A 2/1986 Wegner et al.
4,598,429 A 7/1986 Mulvaney
4,676,861 A 6/1987 Bishop
4,690,932 A 9/1987 Mulvaney
4,701,963 A 10/1987 Overton
4,770,299 A 9/1988 Parker
4,832,010 A 5/1989 Lerman
4,837,884 A 6/1989 Hilgarth
4,843,651 A 7/1989 Gramza et al.
4,864,660 A 9/1989 Sawyer
4,869,046 A 9/1989 Parker
4,964,229 A 10/1990 Laberge
4,966,134 A 10/1990 Brewer
5,003,970 A 4/1991 Parker et al.
5,027,803 A 7/1991 Scholz et al.
5,117,509 A 6/1992 Bowers
D327,754 S 7/1992 Hochgesang et al.
5,183,263 A 2/1993 Kuebler
5,295,269 A 3/1994 Ballard
5,316,294 A 5/1994 Turangan
5,335,916 A 8/1994 Nee
5,364,580 A 11/1994 Prent
5,405,312 A * 4/1995 Jacobs ..... A41D 13/0568 128/892
5,425,701 A 6/1995 Oster et al.
5,456,658 A * 10/1995 Duback ..... A41D 13/065 2/24
5,511,248 A 4/1996 Widdemer
5,517,694 A 5/1996 Fabry
5,537,692 A 7/1996 Dorr
5,480,376 A 8/1996 Duback et al.
5,544,663 A 8/1996 Duback
5,598,582 A 2/1997 Andrews et al.
5,608,912 A 3/1997 Cumberland
5,636,381 A 6/1997 Brogden
5,637,077 A 6/1997 Parker
5,665,056 A 9/1997 Nakasugi et al.
5,692,242 A 12/1997 Tekerman et al.
5,708,979 A 1/1998 Redwood et al.
5,727,257 A 3/1998 Chen
5,732,713 A 3/1998 Duback et al.
5,745,919 A 5/1998 Kraatz
5,755,678 A 5/1998 Parker et al.
5,802,614 A 9/1998 Melone, Jr.
5,806,091 A 9/1998 McHugh
5,833,637 A 11/1998 Pong
5,867,830 A 2/1999 Chen
5,957,871 A 9/1999 Darcey
5,980,474 A 11/1999 Darcey
6,006,358 A 12/1999 Keating
6,022,331 A 2/2000 Darcey
6,044,494 A 4/2000 Kang
6,049,910 A 4/2000 McCarter
6,052,827 A 4/2000 Widdemer
6,065,155 A 5/2000 Sandusky
6,105,162 A 8/2000 Douglas
6,128,777 A 10/2000 Foreman
6,182,293 B1 2/2001 Mustin
6,185,747 B1 2/2001 Hughes
6,223,353 B1 5/2001 Lardieri, Jr.
6,253,382 B1 7/2001 Kleinert
6,408,442 B1 6/2002 Kang
6,457,181 B1 10/2002 Grundy
6,526,593 B2 3/2003 Sajovic
6,539,550 B1 4/2003 Flores
6,681,403 B2 * 1/2004 Lyden ..... A41D 13/05 2/22
6,745,402 B2 6/2004 Caswell
6,745,403 B2 6/2004 Sajovic
6,912,731 B2 7/2005 Cass
6,964,063 B2 11/2005 Bamber
7,210,172 B2 5/2007 Adams, Jr.
7,293,296 B1 11/2007 Beraznik et al.
7,487,553 B2 2/2009 Price
7,669,251 B2 3/2010 Hammons et al.
7,958,570 B1 * 6/2011 Mooney ..... A42B 1/0189 2/195.5
7,966,670 B2 6/2011 Wilbert et al.
7,966,673 B1 * 6/2011 Gibson ..... A42B 1/08 2/412
8,015,621 B2 9/2011 Udelhofen
D660,555 S * 5/2012 Stoltz ..... D2/892
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 9/2012 Ibon et al.
8,266,719 B2 9/2012 Duby
D703,875 S * 4/2014 Lewandowski ..... D29/122
9,198,474 B1 12/2015 Hacobian
10,004,975 B2 6/2018 Clement
10,201,205 B2 * 2/2019 Moore ..... A42B 3/121
11,058,940 B2 7/2021 Gilday et al.
11,083,956 B1 * 8/2021 Varga ..... A63B 71/10
2003/0037364 A1 2/2003 Alber
2004/0025226 A1 2/2004 Jaeger
2004/0045074 A1 3/2004 Tremblay
2004/0060097 A1 4/2004 Bamber
2004/0068777 A1 4/2004 Wheelington, II
2004/0107476 A1 6/2004 Goldwitz
2004/0139531 A1 * 7/2004 Moore, III ..... B29C 44/1204 2/410
2005/0034213 A1 2/2005 Bamber
2006/0101559 A1 * 5/2006 Moore, III ..... A42C 2/007 2/410
2007/0174948 A1 8/2007 Robba
2007/0209097 A1 9/2007 Iacullo
2008/0010719 A1 1/2008 Hoelscher
2008/0229477 A1 9/2008 McGrough
2008/0271224 A1 11/2008 Wilbert et al.
2009/0077706 A1 3/2009 Prather
2009/0139007 A1 6/2009 Bevier
2009/0139010 A1 6/2009 Bevier
2009/0222975 A1 * 9/2009 Green ..... A42C 5/02 2/181
2010/0024095 A1 2/2010 Gellis
2010/0077526 A1 4/2010 Smeltzer
2010/0077532 A1 4/2010 Kettani
2010/0077533 A1 4/2010 Munda
2010/0095428 A1 4/2010 Fisher
2010/0186140 A1 7/2010 Ramirez
2010/0325777 A1 12/2010 Radakrishnan et al.
2011/0041235 A1 2/2011 Harris
2011/0113521 A1 5/2011 Bradford
2011/0214220 A1 9/2011 Parker
2011/0214221 A1 9/2011 Munda
2011/0258754 A1 10/2011 DuPont
2011/0296582 A1 12/2011 Bevier et al.
2012/0005580 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0159681 A1 6/2012 Gibby
2012/0227158 A1 6/2012 Ashworth et al.
2012/0204319 A1 8/2012 Gambordella
2012/0227155 A1 9/2012 Brown
2012/0245503 A1 9/2012 DeVries
2012/0324623 A1 12/2012 Cabauy et al.
2013/0000006 A1 1/2013 Norton
2013/0036523 A1 2/2013 Webster
2013/0061369 A1 3/2013 Lim
2013/0167281 A1 7/2013 Jennings

(56) References Cited

U.S. PATENT DOCUMENTS

| | | | | |
|---|---|---|---|---|
| 2013/0198920 | A1 | 8/2013 | Wittman | |
| 2013/0227755 | A1 | 9/2013 | Bisaillon | |
| 2013/0239291 | A1 | 9/2013 | Harris | |
| 2013/0283498 | A1 | 10/2013 | Hewitt | |
| 2015/0059055 | A1* | 3/2015 | Johnson | A42B 3/10 2/181.4 |
| 2015/0165302 | A1 | 6/2015 | Jaramillo et al. | |
| 2015/0314189 | A1 | 11/2015 | Le | |
| 2016/0324245 | A1* | 11/2016 | Clement | A41D 13/015 |
| 2016/0367881 | A1 | 12/2016 | Le | |
| 2017/0282048 | A1 | 10/2017 | Wittman | |
| 2018/0193718 | A1 | 7/2018 | Gilday et al. | |
| 2018/0255849 | A1 | 9/2018 | Paquette et al. | |
| 2020/0405320 | A1 | 12/2020 | Kawamoto | |
| 2021/0007873 | A1 | 1/2021 | Frederick | |
| 2021/0052968 | A1 | 2/2021 | Ciaglia | |
| 2021/0378332 | A1 | 12/2021 | Tryner et al. | |
| 2022/0088464 | A1 | 3/2022 | Kawiya | |
| 2022/0212087 | A1 | 7/2022 | Kucharsky | |
| 2022/0361617 | A1* | 11/2022 | Boyd | A63B 71/10 |

* cited by examiner

PROTECTIVE LINER FOR HEADWEAR

BACKGROUND

Baseball and softball players frequently wear what are known as baseball caps. Such caps are frequently worn by a team's pitcher, infielders, and outfielders. Such baseball caps typically include a soft fabric crown and a forwardly extending visor. Such baseball caps offer little protection for a player's head from ball impacts.

Figure 1:
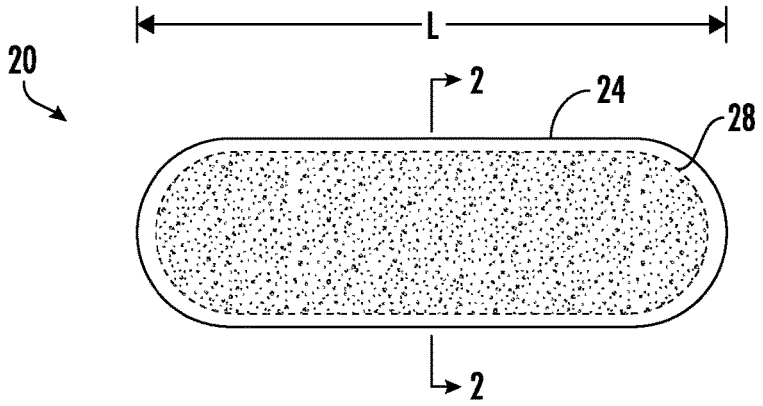
FIG. 1 is a top of an example protective headwear liner prior to being shaped, hardened, and customized.

Throughout the drawings, identical reference numbers designate similar, but not necessarily identical, elements. The FIGS. are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are example protective headwear liners that may line headwear, such as a baseball cap, to enhance the ability of the headwear to absorb and disperse the force of impacts, such as impacts from a baseball or softball, to reduce head injuries caused by such impacts. The example protective headwear liners may be form fitted to an individual player's head, providing a customized fit. The customized fit may enhance the ability of the liner to retain its desired positioning on the player's head. The customized fit may better conform to the player's head such that smaller, sleeker, and more attractive headwear may be used with the liner. Although the example protective headwear liners are illustrated as being specifically configured for use in baseball caps, the various features of the example protective headwear liners may be utilized as part of liners for other headwear such as lacrosse helmets, batting helmets, football helmets, base coach helmets, umpire headwear, pitcher's headwear, biking helmets, ski and snowboard helmets, or any other type of headwear where such a customizable liner might offer enhanced head protection.

Disclosed is an example protective headwear liner that may include an encasement and a moldable and hardenable material within the encasement. The encasement is deformable to a U-shape while containing the material prior to hardening of the material. The U-shape extends in an arc and may have a generally flat front and two generally flat sides corresponding to a front and sides of a person's head, respectively, wherein the two flat sides are joined to the flat front by curves. The material is configured to retain the U-shape following hardening of the material.

Disclosed is an example protective headwear system that comprises a baseball cap and an example protective headwear liner. The baseball cap may include a sweatband, wherein the protective headwear liner is receivable within the sweatband. The protective headwear liner may include an encasement and a moldable and hardenable material within the encasement. The encasement is deformable to a U-shape while containing the material prior to hardening of the material. The U-shape may have a generally flat front and two generally flat sides corresponding to a front and sides of a person's head, respectively, wherein the two flat sides are joined to the flat front by curves. The material is configured to retain the U-shape following hardening of the material.

In some implementations, the protective headwear liner is removable from the sweatband. In some implementations, the protective headwear liner is permanently retained or nonremovable from the sweatband or non-removable from an alternative corresponding sleeve, channel, pocket, or the like on an inside of the baseball cap. For example, in some implementations, the protective headwear liner may be sealed or sewn within the corresponding sleeve, channel, pocket or the like on the inside of the baseball cap. In some implementations, the encasement with the un-hardened material is non-removably received within the sleeve, channel, pocket, or the like on the inside of the baseball cap, wherein the material may be subsequently hardened while the baseball cap is being worn by a person for which the baseball cap and the liner are being customized.

Disclosed an example method for forming a protective headwear system. The method includes inserting a protective headwear liner into a baseball cap, wherein the protective headwear liner includes an encasement; and a moldable and hardenable material within the encasement. The encasement is deformable to a U-shape while containing the material prior to hardening of the material and wherein the material is configured to retain the U-shape following hardening of the material. The method may further include deforming the encasement to a desired shape while within the baseball cap and hardening the material within the encasement while the encasement is in the desired shape.

Disclosed is an example protective headwear liner that comprises a hardened and rigid U-shaped band. The U-shaped band may be molded and hardened while within a headwear, such as a baseball cap, while the headwear is being worn by a person or while the headwear is otherwise supported. The U-shaped band may be molded and hardened while being pressed against a person's for head and about sides of the person's head to customize the band to the person's head. In some implementations, the U-shaped band may be preformed/pre-shaped so as to have its U-shape before receipt or use of the band by the person to wear the liner or before insertion into the headwear, such as the baseball cap. For example, liner may be manufactured and preformed prior to sale. The liner may be manufactured and preformed/pre-shaped prior to insertion into headwear, such as a baseball cap.

In some implementations, the protective headwear liner, whether permanently shaped while being worn by a person or whether permanently shaped prior to retail sale or prior being worn, may comprise a lower edge, a center front portion having a first height above the lower edge, a first wing portion extending from a first side of the center front portion and a second wing portion extending from a second side of the center front portion. The first wing portion may have a second height above the lower edge and greater than the first height and the second wing portion may have the second height. In some implementations, the liner further comprises an upper edge opposite the lower edge, wherein the upper edge comprises a first notch between the center front portion and the first wing portion and a second notch portion between the center front portion and the second wing portion.

Figure 2:
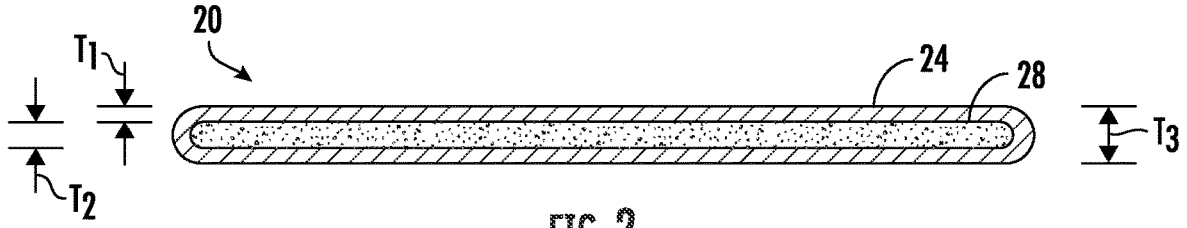
FIG. 2 is a sectional view of the example protective headwear liner of FIG. 1 taken along line 2-2.

FIGS. 1 and 2 illustrate an example protective headwear liner 20. FIG. 1 is a top plan view of liner 20 prior to being molded and prior to being hardened. FIG. 2 is a sectional view of the liner of FIG. 1 taken along line 2-2. Liner 20 is configured for lining a headwear to provide additional head protection for a person wearing the headwear. In some implementations, liner 20 is configured to be inserted into such headwear, extending between the headwear and a person's head. In some implementations, liner 20 may be joined to the headwear on an exterior of the headwear or at least partially within portions of the headwear. Liner 20 enhances the ability of the headwear to absorb and disperse the force of impacts, such as impacts from a baseball or softball, to reduce head injuries caused by such impacts. The example protective headwear liners may be form fitted to an individual player's head, providing a customized fit. The customized fit may enhance the ability of the liner to retain its desired positioning on the player's head. The customized fit may better conform to the player's head such that smaller, sleeker, and more attractive headwear may be used with the liner.

Liner 20 comprises encasement 24 and a moldable and hardenable material 28. Encasement 24 comprises a flexible enclosure containing material 28. Encasement 24 is deformable to a U-shape while containing the material 28 prior to hardening of the material 28. Encasement 24 is deformable or bendable to a U-shape that has a generally flat front and two sides corresponding to a front and sides of a person's head, respectively, wherein the two flat sides are joined to the flat front by curves. In some example implementations, the encasement may comprise an imperforate bag, pouch, or the like in which the moldable and hardenable material is sealed. In some example implementations, the encasement may comprise a flexible polymer such as suede or nubuck. In other implementations, the encasement can be formed of other materials and combinations of materials. In implementations where hardening of material 28 may require air, such as a GEL-TO SHELL material, encasement 24 is formed from a material that is air permeable or includes openings facilitating the transmission of air.

The moldable and hardenable material 28 is received within the encasement 24 and is sufficiently soft, viscous, or flexible such that the encasement 24 may be deformed to the U-shape prior to hardening of the material 28. In some implementations, material 28 is hardenable in response to the application of external stimuli such as heat, light, or the like. In some implementations, material 28 is hardenable in response to a chemical reaction triggered in response to the breaking of one or more internal compartments within encasement 24 that allow chemical elements from the different compartments to combine for a reaction. In some implementations, material 28 is hardenable in response reaction with elements in the air. In some implementations, material 28 comprises a viscous fluid or gel. In some implementations, material 28 comprises a "GEL-TO-SHELF" technology material sold by EvoShield®. Once hardened, material 28 retains its shape. In the examples, once hardened, material 28 is retained in the U-shape of encasement 24, also retaining encasement 24 in the U shape. Once hardened, material 28 has a sufficient strength and rigidity to enhance the ability of the associated headwear to absorb and disperse the force of impacts, such as impacts from a baseball or softball, to reduce the likelihood of head injuries caused by such impacts.

In some implementations, liner 20 is configured to be lightweight and thin, allowing liner 20 to be comfortably and inconspicuously worn by a person during a sporting event or competition. In some implementations, encasement 24 has a thickness T1 of approximately 0.1 inch. In some implementations, material 28 has a thickness T2 of approximately 0.25 inch. In some implementations, the protective headwear liner 20 has a maximum thickness T3 of no greater than 0.7 inch. In one implementation, the thickness T3 is 0.3 inch. In some implementations, liner 28 has a length L of at least 9 inches and no greater than 18 inches. In some implementations, liner 28 has a weight of no greater than 8 ounces. In one implementation, the liner 28 has a weight of approximately 6 ounces. In other implementations, the liner 20 can have other thickness dimensions for T1, T2 and T3, and weights.

Figure 3:
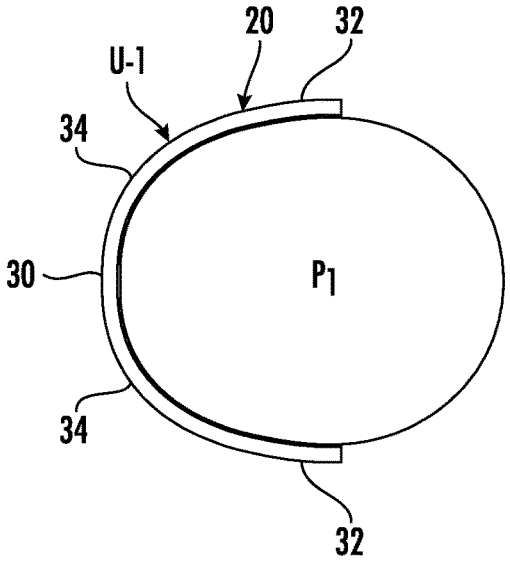
FIG. 3 is a top view illustrating shaping and hardening of the protective liner of FIG. 1 about a head of a first person.
Figure 4:
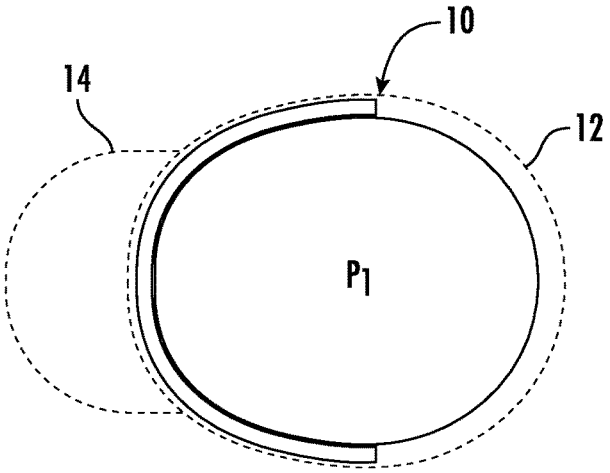
FIG. 4 is a top view of the shaped and hardened protective headwear liner of FIG. 3 joined to an example protective headwear in the form of a baseball cap.

FIG. 3 illustrates the molding, deforming, and shaping of liner 20 to customize liner 20 to the size and shape of a head of a first person P1. FIG. 3 illustrates liner 20 after it has been deformed into the U-shape U-1 which comprises a generally flat front portion 30 and to generally flat sides 32, which are joined to the front portion by curves or curved portions 34. In some implementations, liner 20 is deformed or shaped prior to being connected to or being received within headwear. For example, as shown by FIG. 3, liner 20 may be pressed against the head of person P1, causing liner 20 closely conform to the individual unique shape and size of the head of person P1. As shown by FIG. 4, liner 20 may alternatively be joined to or inserted into a headwear 10 (shown as a baseball cap having a crown 12 and visor 14) which is itself flexible or shapeable, wherein the headwear 10 with the received liner 20 are both concurrently shaped to closely conform to the unique shape and size of the person P1. Once liner 20 has been shaped, liner 20 is then hardened, retaining its shape which closely conforms to the head of person P1.

Figure 5:
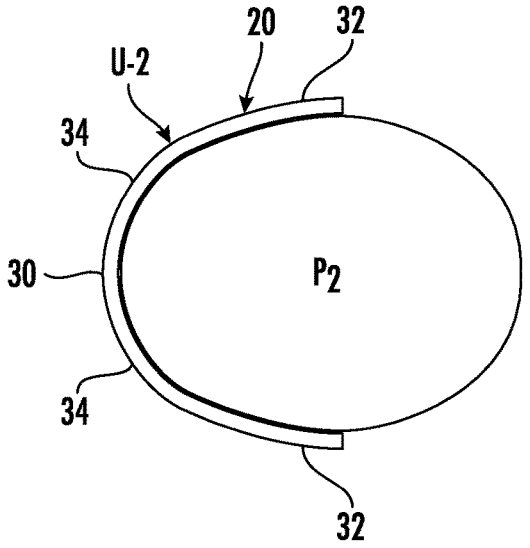
FIG. 5 is a top view illustrating shaping and hardening of the protective liner of FIG. 1 about a head of a second person.
Figure 6:
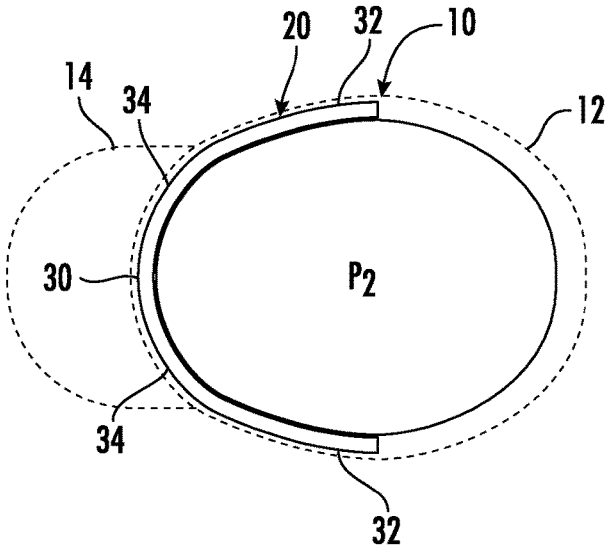
FIG. 6 is a top view of the shaped and hardened protective headwear liner of FIG. 5 joined to an example protective headwear in the form of a baseball cap.

FIGS. 5 and 6 illustrate liner 20 being alternatively molded, deformed and shaped to customize liner 20 to a U-shape U-2 corresponding to the size and the shape of a head of a second person P2, wherein the size and the shape of the head of person P2 are different than the size and shape of the head of person P1. FIG. 5 illustrates the shaping of liner 20 independent of a headwear. FIG. 6 illustrates the shaping of liner 20 while liner 20 is received within or otherwise joined to headwear 10. As demonstrated by FIGS. 3-6, the shape of liner 20 may be customized to different individuals having different head sizes and shapes. The customized fit of liner 20 may enhance the ability of the liner to retain its desired positioning on the head of person P1 or P2. The customized fit of liner 20 may better conform to the player's head such that smaller, sleeker, and more attractive headwear 10 may be used with the liner 20.

Figure 7:
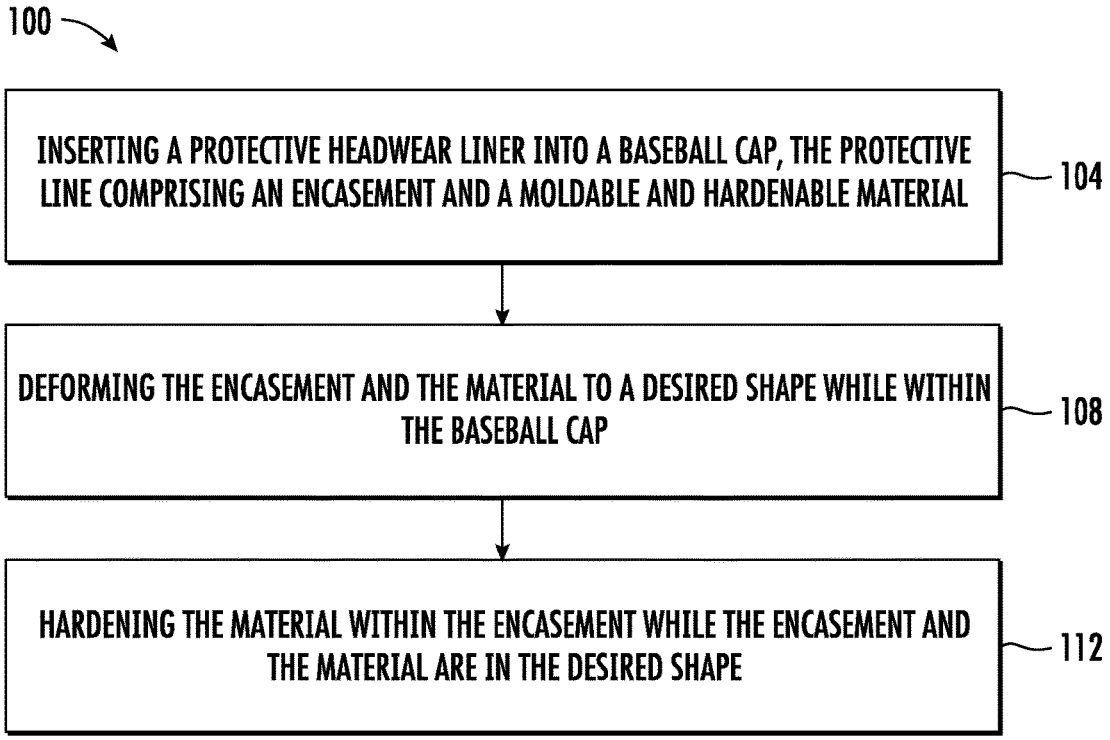
FIG. 7 is a flow diagram of an example method for forming an example protective headwear system.

FIG. 7 is a flow diagram illustrating an example method 100 for forming a protective headwear liner or for forming a protective headwear system which includes a protective headwear liner and the associated headwear. Although method 100 is specifically described in the context of a protective headwear in the form of a baseball cap, method 100 may likewise be carried out with other forms of headwear.

As indicated by block 104, a protective headwear liner is inserted into a baseball cap. The protective headwear liner may comprise an encasement and a moldable and hardenable material within the encasement.

As indicated by block 108, the encasement and the material (prior to hardening of the material) are deformed to a desired shape while within the baseball cap. In some implementations, the encasement and the enclosed material are deformed or shaped to so as to have U-shape formed by a flat front and to flat sides that are joined to the flat front by curves, wherein the flat front and the two flat sides have shapes and sizes that correspond to a front and sides of a person's head, respectively. In some implementations, encasement and the enclosed material are deformed by pressing outer surfaces of the baseball cap towards the head of the person wearing the baseball cap such that the encasement and the enclosed material directly or indirectly abut against the person's head and deform so as to have a size and shape are closely matching the unique contours of the person wearing the baseball cap.

As indicated by block 112, the material within the encasement is hardened while the encasement in the enclosed material are in the desired shape. In some implementations, the material hardens while the encasement and the enclosed material are pressed against the head of the person wearing the baseball cap and while the protective headwear liner is received within or otherwise joined to the baseball cap. Once hardened, the material within the encasement retains the encasement and the overall liner in the desired shape that better conforms to the unique size and shape of the head of the person wearing the baseball cap. As a result, the customized fit of liner may enhance the ability of the liner to retain its desired positioning on the head of person P1 or P2. The customized fit of liner may better conform to the player's head such that smaller, sleeker, and more attractive baseball may be used with the liner.

Figure 8:
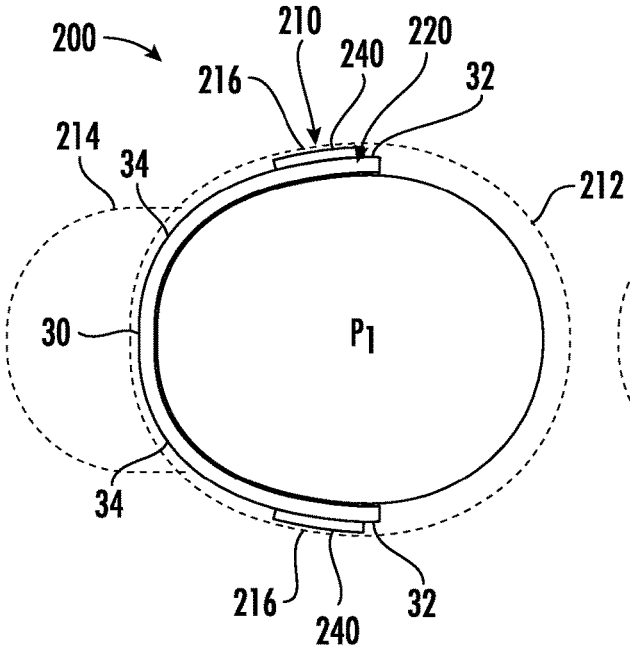
FIG. 8 is a top view of an example effective headwear liner joined to an example protective headwear.
Figure 9:
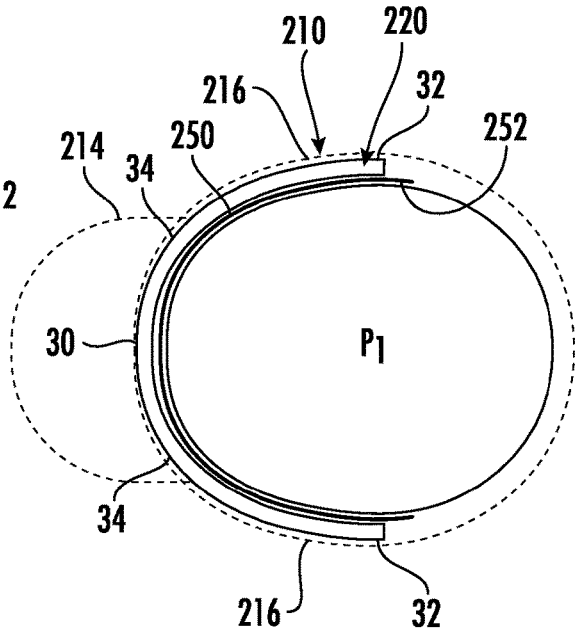
FIG. 9 is a top view of an example protective headwear liner joined to an example protective headwear.

FIG. 8 is a top view of an example headwear protection system 200 customized to the size and shape of person P1. The example headwear protection system 200 is formed by an example headwear 210, in the form of a baseball cap, and a headwear protective liner 220 that as a shape customized according to the size and shape of the head of person P1. Headwear protective liner 220 is similar to headwear protective liner 20 described above except that headwear protective liner 220 additionally comprises retainer 240 (schematically illustrated).

Retainer 240 retains or secures liner 220 to headwear 210, inhibiting shifting of liner 220 relative to headwear 210. In some implementations, retainer 240 permanently or fixedly secures liner 220 to headwear 210. In such implementations, retainer 240 may comprise permanent fasteners such as one or more fasteners, rivets, stitching, adhesives, welds, or the like. In such implementations, the permanent joining of liner 222 headwear 210 may occur before, during or after the shaping of liner 220 and the hardening of material 28 within encasement 24.

In some implementations, retainer 240 is configured to removably or releasably connects or secures liner 220 relative to headwear 210. For purposes of this disclosure, the phrase "configured to" denotes an actual state of configuration that fundamentally ties the stated function/use to the physical characteristics of the feature proceeding the phrase "configured to". For purposes of this disclosure, the term "releasably" or "removably" with respect to an attachment or coupling of two structures means that the two structures may be repeatedly connected and disconnected to and from one another without material damage to either of the two structures or their functioning. As a result, liner 220 may be removed from headwear 210 when the additional headwear protection offered by liner 220 is no longer needed or desired. Liner 220 may be removed from headwear 210 for cleaning, repair, or replacement. In some implementations, liner 220 may be added to an existing headwear 210 to enhance the existing headwear 210.

In some implementations, retainer 240 may include a fastening or connection arrangement having a first component directly secured to headwear 210 and a second corresponding component directly secured to the remainder of liner 220. For example, in some implementations, retainer 240 may comprise a hook and loop fastener (VELCRO™) arrangement, wherein one of hook and loop material is directly secured to an outer surface of liner 220 while the other of the hook and loop material is directly secured to an inner surface of headwear 210. In some implementations, retainer 240 may comprise a releasable snap connection, wherein a first portion of the releasable snap connection is directly secured to an outer surface of liner 220 while a second portion of the releasable snap connection is directly secured to an inner surface of headwear 210.

In some implementations, retainer 240 may be solely contained or carried by liner 220 without any physical modification or supplementation of headwear 210. In some implementations, retainer 240 may include a hook or other structure that engages in existing portion of headwear 210. For example, with respect to a baseball cap having a crown 212 and a visor 214, retainer 240 may comprise a U-shaped extension that wraps about a lower edge or lower rim of one or both side panels 216 that form the soft fabric crown 212 of the baseball cap (headwear 210), wherein the U-shaped extension forms a channel that receives the lower edge and that grips the side panels of the baseball cap to releasably secure liner 220 relative to baseball cap.

In some implementations, liner 220 may be additionally or releasably secured to headwear 210 by being shaped and sized to connect with existing structures of the headwear 210. For example, as shown by FIG. 8, with respect to headwear 210 in the form of a baseball cap, liner 220 may be configured to be received within a channel 250 formed by the internal sweatband 252 extending along the lower edge of the crown. In some implementations, the deformation or shaping of liner 220 may occur while liner 220 is received within the channel formed by the internal sweatband. In some implementations, the deformation or shaping of liner 220 may occur independent of the baseball cap, wherein once shaped, and hardened, liner 220 is subsequently inserted into the channel formed by the internal sweatband. In some implementations, liner 220 may be secured to the baseball cap without any additional retainer, for example, without any additional snap fastener, hook, and loop fastener, and/or U-shaped extension.

Figure 10:
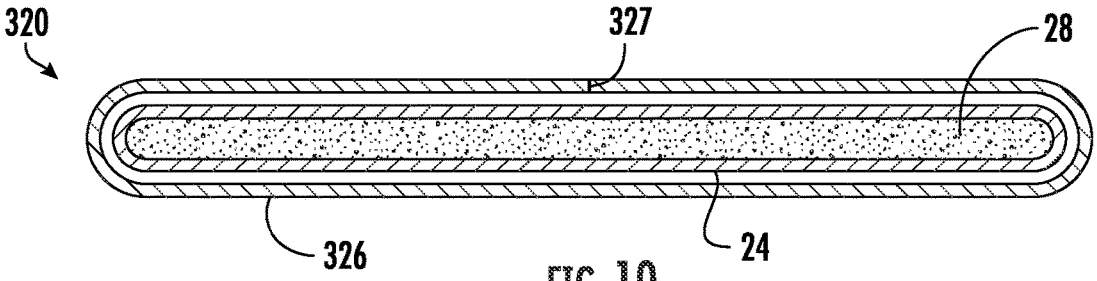
FIG. 10 is a sectional view of an example protective headwear liner prior to being shaped, hardened, and customized.

FIG. 10 is a sectional view of an example headwear protection liner 320. FIG. 10 illustrates an example of how additional encasements, panels or other materials may be provided on or about encasement 24 to enhance the performance of liner 320. Liner 320 is similar to liner 20 described above except that liner 320 additionally comprises outer covering 326. Those remaining components of liner 320 which correspond to components of liner 20 are numbered similarly.

Outer covering 326 extends on or about an exterior of encasement 24. In the example illustrated, outer covering 326 completely encloses and extends about all size and faces of encasement 324. Like encasement 24, outer covering 326 has a thickness and is formed from a material that allows outer covering 326 along with encasement 24 and contained un-molded material 28 to be deformed or shaped to the U-shape described above. Outer covering 326 protects encasement 324, especially in those implementations where encasement 24 might be punctured and contains a viscous fluid material 28. In some implementations, outer covering 326 comprises multiple panels stitched are sewn to one another about encasement 24. In some implementations, outer covering 326 is imperforate. In some implementations, outer covering 326 is imperforate, preventing the transmission of air therethrough to facilitate hardening of a GEL-TO-SHELL material 28 when triggered. In some implementations, outer covering 326 is formed from a fabric or other material that may absorb perspiration. In some implementations, outer covering 326 may form from material that resists the absorption of perforation to resist odor. In some implementations, outer covering 326 is formed from a material such as Suede or Nubuck. In yet other implementations, outer covering 326 may partially cover encasement 24 covering selected portions of encasement 24. In other implementations, outer covering 326 may itself be coated with other materials.

In some implementations, outer covering comprise a pocket having an opening 327 through which encasement 24 and the enclosed liner 20 may be withdrawn from outer covering 326, facilitating replacement or cleaning of the outer covering 326 or facilitating the replacement of encasement 24 and the enclosed material 28. Opening 327 may comprise a slit in outer covering 326 or a door. In such implementations, the slit or door may additionally comprise a closing mechanism such as a hook and loop fastener, snap, or the like.

Figure 11:
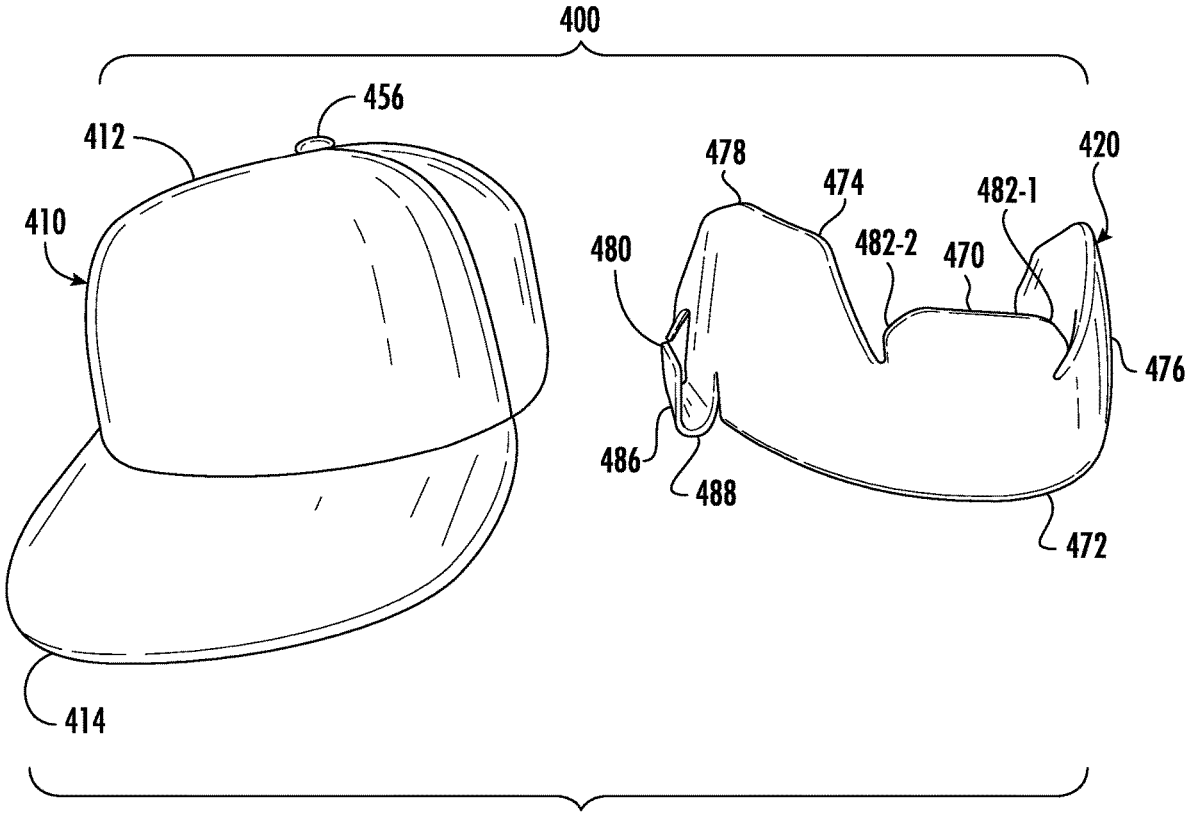
FIG. 11 a top perspective view of an example unassembled protective headwear system.
Figure 12:
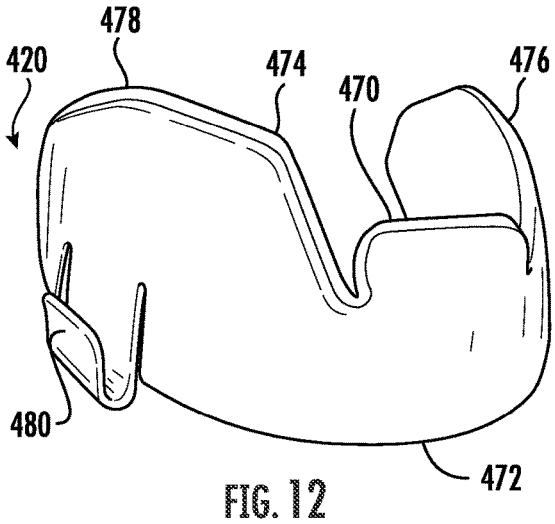
FIG. 12 is a front perspective view of an example protective headwear liner of the system of FIG. 11.
Figure 13:
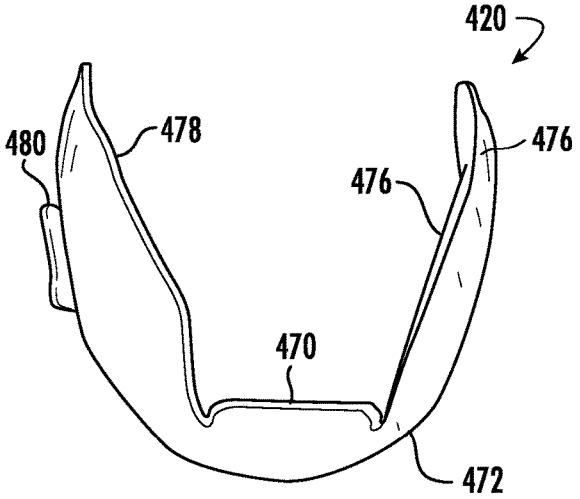
FIG. 13 is a top perspective view of the example protective headwear liner of the system of FIG. 11.
Figure 16:
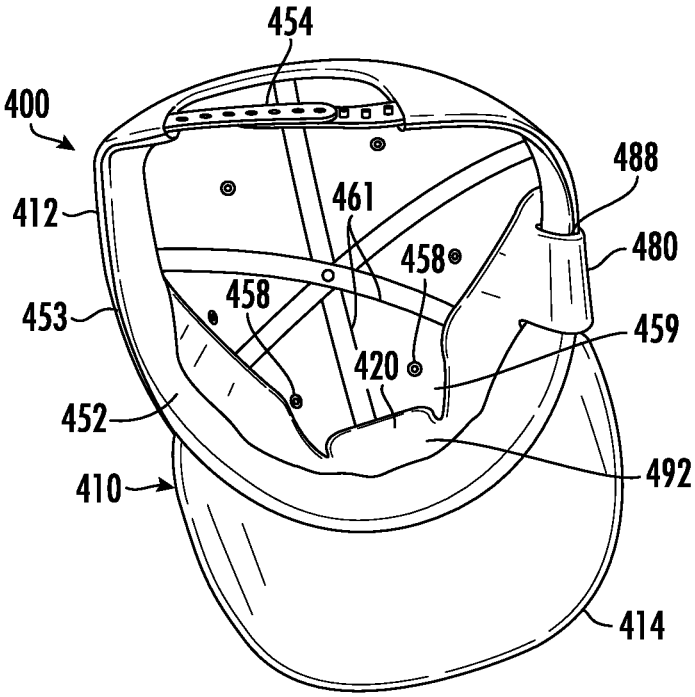
FIG. 16 is a bottom perspective view of the example assembled protective headwear system of FIG. 11.

Referring to FIGS. 11 and 16, top and bottom perspective views of an example protective headwear system 400 are illustrated. System 400 comprises outer headwear in the form of a baseball cap 410 and a protective headwear liner 420. As with headwear 210, baseball cap 410 comprises a crown 412 and a visor 414 (also referred to as a bill or brim). Crown 412 may be formed from multiple fabric panels which are joined to one another such as through stitching to form crown 412. Baseball cap 410 comprises a sweatband 452 extending along a lower rim 453 of crown 412. In some implementations, sweatband 452 may be omitted.

In the example illustrated, baseball cap 410 additionally comprises an adjustable rear closure 454. Although closure 454 is illustrated comprising a multi-hole plastic snapback, in other implementations, closure 454 may comprise other types of an adjustable closure such as a fabric strap with buckle, a fabric strap with D ring, a hook and loop closure, a plastic buckle, an adjustable V clip (also referred to as a sliding buckle), a locking brass buckle, and the like. In other implementations, closure 454 may not be adjustable or may be omitted such as where the lower rim of crown 412 is continuous. Although baseball cap 410 is illustrated as including other components such as button 456 (shown in FIG. 11), eyelets 458 (shown in FIG. 16), buckram 459 (shown in FIG. 16), and inner seam taping 461 (shown in FIG. 16), in other implementations, baseball cap 410 may omit one or more of such components. In other implementations, the baseball cap 410 can be formed to expand or adjust to a user's head without the use of the closure 454.

Referring to FIGS. 11-17, protective headwear liner 420 is to be joined to baseball cap 410 by being inserted into the crown 412 of baseball cap 410. Protective headwear liner 420 is shaped to facilitate insertion of liner 420 into the channel formed by the sweatband 452 of cap 410. Liner 420 is further shaped to provide a built in or integral retainer for releasably securing liner 420 in place within and relative to cap 410. In addition, liner 420 is shaped to provide enhanced protection for the head of the person wearing cap 410 while permitting certain portions of cap 410 to bend, flex, and/or collapse such that cap 410 may more comfortably fit the person wearing cap 410 while achieving a sleek shape. Protective headwear liner comprises a center front portion 470, lower edge 472, upper edge 474, wing portion 476, wing portion 478, and a hanging portion or temporal portion 480.

Center front portion 470 projects upwardly from lower edge 472 at a central portion of the U-shaped liner between wing portions 476 and 478. Center front portion 470 is located so as to extend behind a front of crown 412, rearward of visor 414 when liner 420 is received within cap 410. Center front portion 470 has a height, as measured from lower edge 472, that is less than the heights of wing portions 476 and 478. As a result, those portions of the front panel of cap 410 extending vertically above center front portion, between center front portion 470 and the button 456 or the apex of crown 412 of cap 410 are not backed by liner 420 and are permitted to bend and collapse.

Wing portions 476 and 478 extend from opposite sides of center front portion 470. Wing portions 476 and 478 each have a height, as measured from lower edge 472, that is greater than the height of center front portion 470. As a result, wing portions 476 and 478 provide a larger area of protection along the sides of cap 410. As discussed above, the shorter front center portion 470 facilitates collapsing of the front top portions of crown 412.

In the example illustrated, the U-shape formed by center front portion 470 and wing portions 476, 478 extends in an arc having a circumferential length of at least 9 inches and no greater than 18 inches. In one implementation, the circumferential length is 14.5 inches. In the example illustrated, front center portion 470 and wing portions 476 and 478 have a height of at least 1 inch and no greater than 4 inches. In one implementation, the front center portion has a height of 2.6 inches, and wing portions 476 and 478 have a height of 3.25 inches. In other implementations, other dimensions can be used.

In the example illustrated, front center portion 470 and wing portions 476, 478 are integrally formed as part of a single unitary body, wherein a continuous mass of material forms at least portions of front center portion 470 and both the wing portions 476, 478. In the example illustrated, a continuous mass of material forms a core portion of liner 428. The core portion is then surrounded by an outer encasement and/or covering. In some implementations, the outer encasement and/or covering may be formed from multiple panels stitched, sewn, fused, fastened, or otherwise joined to one another about the core. In some implementations, liner 420 is formed from the continuous mass of material forming the core and forming the front center portion 470 and wing portions 476, 478, without any additional outer covering or encasement.

In other example implementations, front center portion 470 and wing portions 476, 478 may be formed from separate continuous masses of material which are individually shaped, and which are joined to one another by an outer encasement and/or covering that encloses each of the individual separate continuous masses or panels of material. For example, in some implementations, the outer encasement and/or covering may itself be flexible so as to form flexible living hinges between the individual continuous masses or panels of material that form the individual front center portion 470 and wing portions 476, 478.

In the example illustrated, center front portion 470 has a first degree of verticality, whereas wing portions 476 and 478 have a second lesser degree of verticality, with the upper portions of such wing portions 476 and 478 curving inwardly. The inward curvature of wing portions permits those portions of cap 410 adjacent the upper portions of such wing portions 476 and 478 two also deform or collapse inwardly, towards button 456. At the same time, the greater verticality of center front portion 470 assists in maintaining and supporting the frontward most central panel of crown 412, supporting the logo, marking or other indicia (the "W" in the example illustrated) on the front most central panel of crown 412. In some implementations, center front portion vertically extends upwardly from the lower edge 472 without bending about a horizontal axis.

Top or upper edge 474 extends opposite to lower edge 472. In the example illustrated, upper edge 474 comprises notches 482-1 and 482-2 (collectively referred to as notches 482) on opposite sides of center front portion 470. Notch 482-1 extends downwardly between center front portion 470 and wing 476. Notch 482-2 extends downwardly between center front portion 470 end wing 478. The shorter height of center front portion 470 and the provision of notches 482 reduce bunching or overlapping of the material of 410 at the sides of the four head of the person wearing cap 410 as such locations are where the most curvature occurs. As a result, notches 482 further enhance the enhanced shaping of cap 410, permitting cap 410 to be sleek and attractive. In some implementations, notches 482 may be omitted In the example illustrated, those portions of upper edge 474 extending rearwardly from notches 482 and forming the top edge of wings 476 and 478 have a curved or polygonal convex shape. The upper edge 474 of each of wing portions 476, 478 may have a convex curvature extending from the notch 482-1, 482-2 to a rearward most terminus of the respective wing portion. This convex shape conforms to the round dome-shape of crown 412. As a result, rear portions of crown 412 of cap 410 may better conform to the round shape of the head of the person wearing cap 410.

Figure 17A:
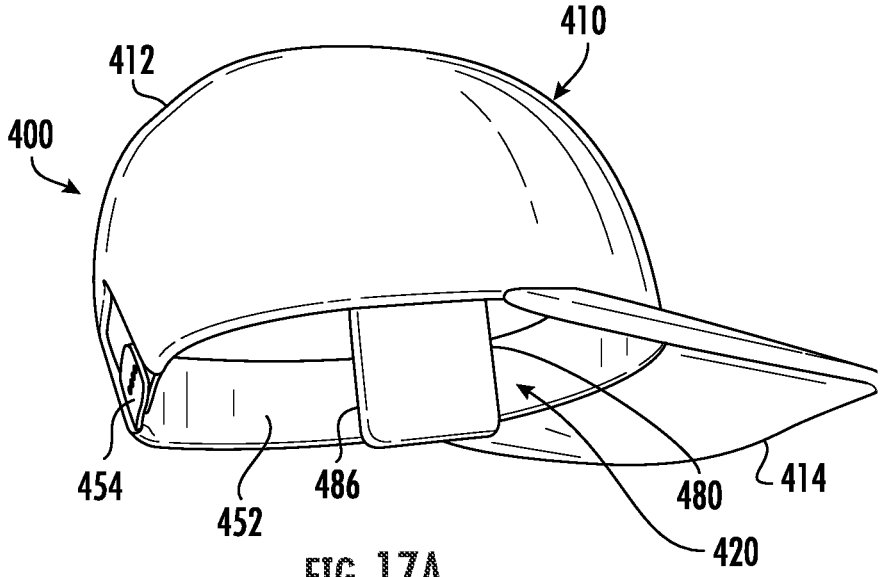
FIG. 17A is a side perspective view of the example assembled protective headwear system of FIG. 11.

Referring to FIGS. 11-14, hanging portion 480 hangs from or extends down from wing portion 478, projecting below lower edge 472. Hanging portion 480 is located so as to generally extend across a temporal lobe of the person wearing baseball cap 410. Referring to FIG. 17A, in some implementations, hanging portion is planar extending down from the wing portion 478 and the baseball cap 410 to provide additional protection to the temple region of the user's head. In the example illustrated, hanging portion 480 has a stiffness or rigidity similar to that of the rest of liner 420. In the example illustrated, hanging portion 480 is formed as a single integral unitary body with wing portion 478, wherein a continuous mass of material forms at least portions of front center portion 470, both the wing portions 476, 478 and hanging portion 480. In the example illustrated, a continuous mass of material forms a core portion of liner 428. The core portion is then surrounded by an outer encasement and/or covering. In some implementations, the outer encasement and/or covering may be formed from multiple panels stitched, sewn, fused, fastened, or otherwise joined to one another about the core.

Figure 17B:
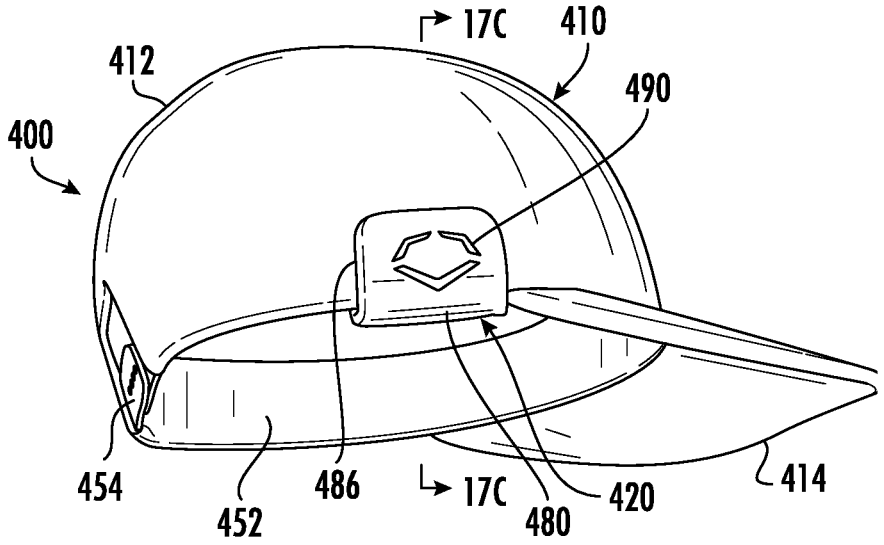
FIG. 17B is a side perspective view of another implementation of the example assembled protective headwear system of FIG. 11.

Referring to FIGS. 11-16, 17B and 17C, in other implementations hanging portion 480 additionally comprise an upturned portion 486 such that hanging portion 480 has a U-shape. As shown by FIGS. 16 and 17B, hang portion 480 wraps around the lower edge 472 of cap 410, or in the lower edge 472 of cap 410 is received within channel 488 formed by upturned portion 46. As a result, hang portion 480 serves as a retainer for securing liner 420 in place relative to cap 410. Although liner 420 is illustrated as comprising a single hanging portion 480 projecting from or hanging from wing 478, in some implementations, liner 420 may comprise multiple spaced hanging portions 480 projecting from wing portion 478 for enhanced securement. In some implementations, wing 476 may likewise comprise a single hanging portion 480 or multiple hanging portions 480. In some implementations, hanging portion 480 may omit the upturned portion 486, wherein hanging portion 480 does not serve as a retainer, but protects the temporal lobe of the person wearing cap 410.

Figure 15:
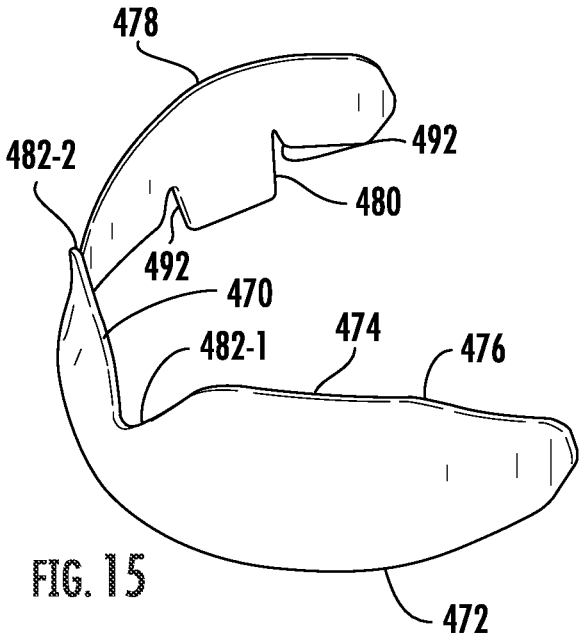
FIG. 15 is a left-side perspective view of the example protective headwear liner of the system of FIG. 11.

As shown by FIG. 17B, an outer face of upturned portion 46 may additionally comprise indicia 490 on its outmost surface. Indicia 490 may comprise a logo, design, text, graphics or the like which indicates to others, when cap 410 is being worn, that the baseball cap 410 is additionally provided with protective headwear liner 420. Such indicia 490 may serve as an indicator that the person wearing baseball cap 410 is adequately protected such as in circumstances where the use of protective liner 420 is mandated as a safety precaution. As shown by FIG. 15, the back face or inner face of center front portion 470 is additionally provided with an indicium 492 to indicate the inclusion of liner 420 within cap 410. In some implementations, indicia 490 and/or 492 may be omitted.

Figure 17C:
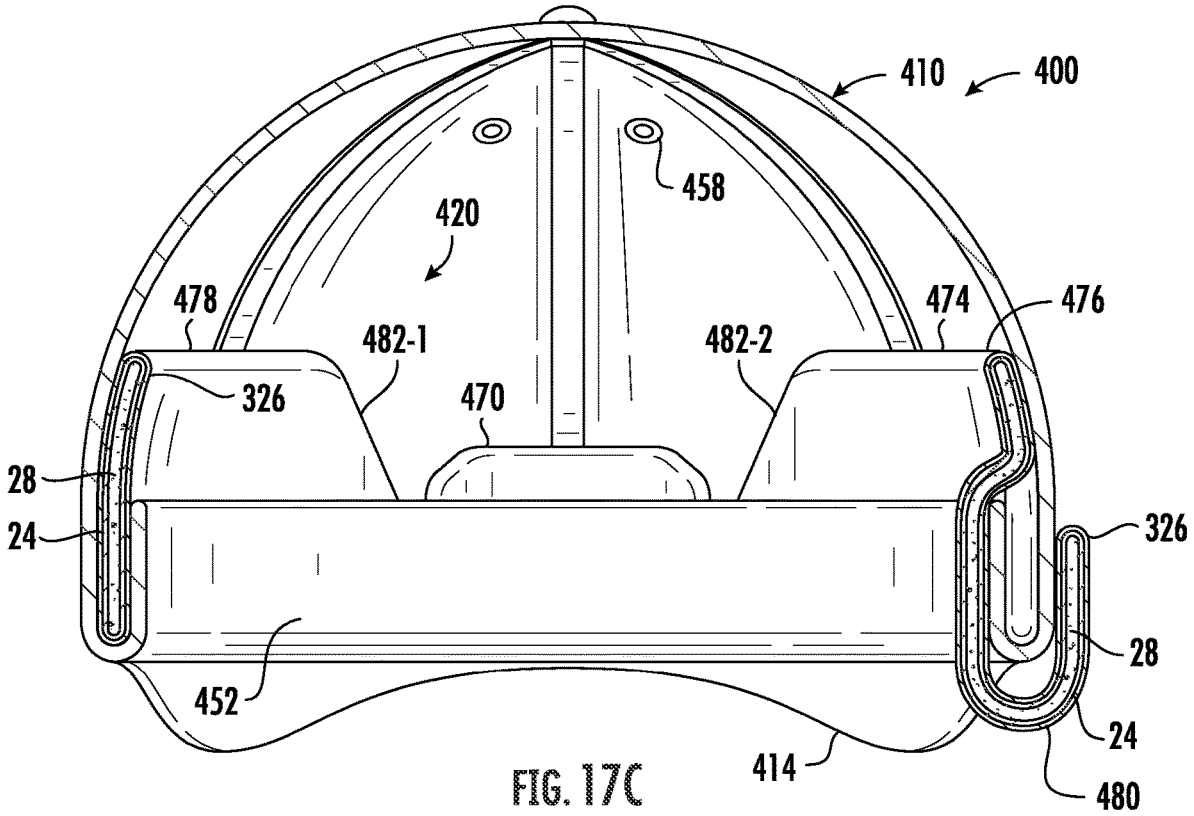
FIG. 17C is a rear, cross-sectional view of the baseball cap and the insert taken along line 17B-17B of FIG. 17B.
Figure 19:
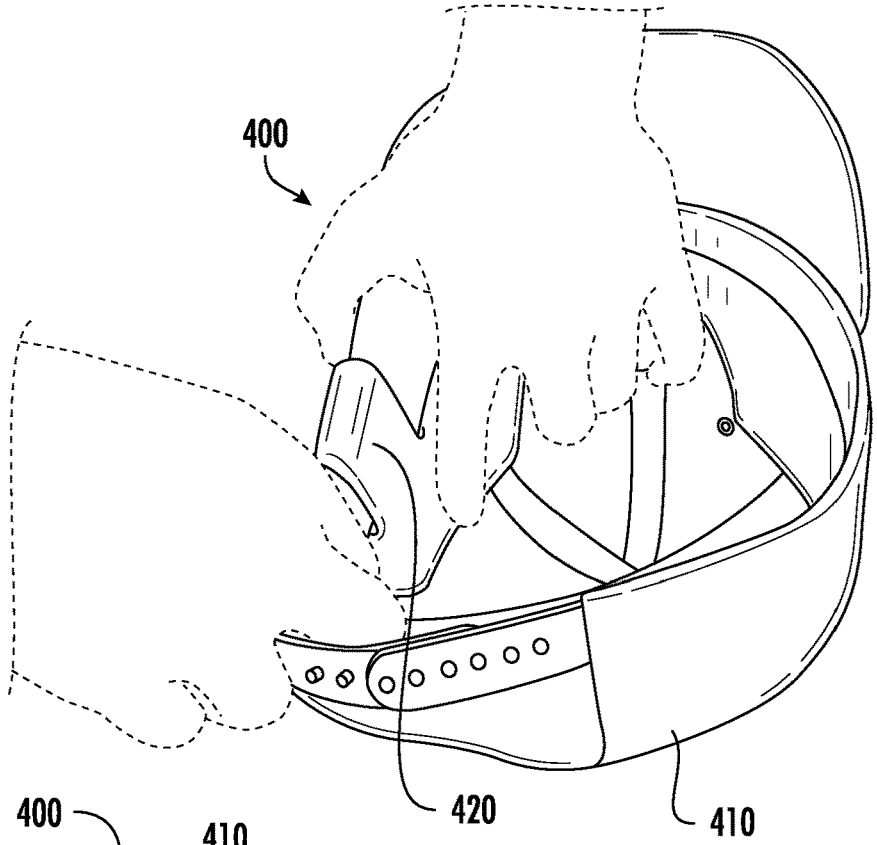
FIG. 19 is a bottom perspective view illustrating insertion of the example protective liner of FIG. 8 into an example protective headwear prior to shaping, hardening customization of the liner.

As shown by FIGS. 16, 17C and 19, liner 420 is configured to fit within an interior channel formed by sweatband 452, extending between sweatband 452 and crown 412. As a result, the existing sweatband 452 further assists in retaining liner 420 in place relative to cap 410. In the example illustrated, liner 420, or at least those portions of liner 420 that are to be received within the channel formed by sweatband 452 facilitating insertion into the pre-existing channel. In some implementations, additional retention mechanisms, such as snaps, right hook, and loop fastener, may be provided on the inner surface of sweatband 452 for further retaining portions of liner 420 within the channel.

Figure 14:
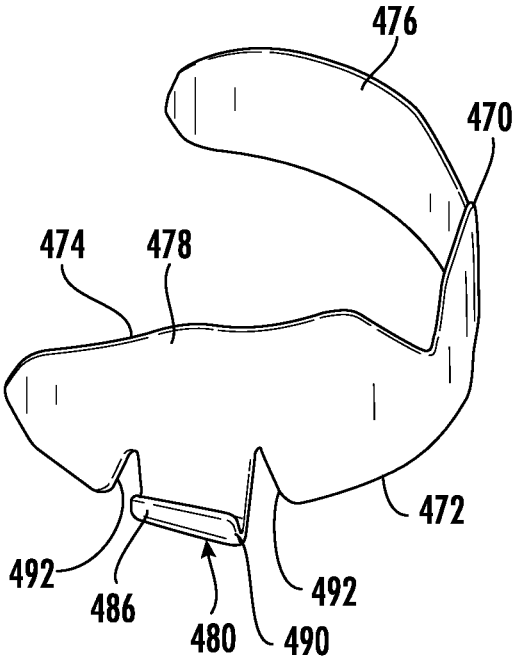
FIG. 14 is a right-side perspective view of the example protective headwear liner of the system of FIG. 11.
Figure 18:
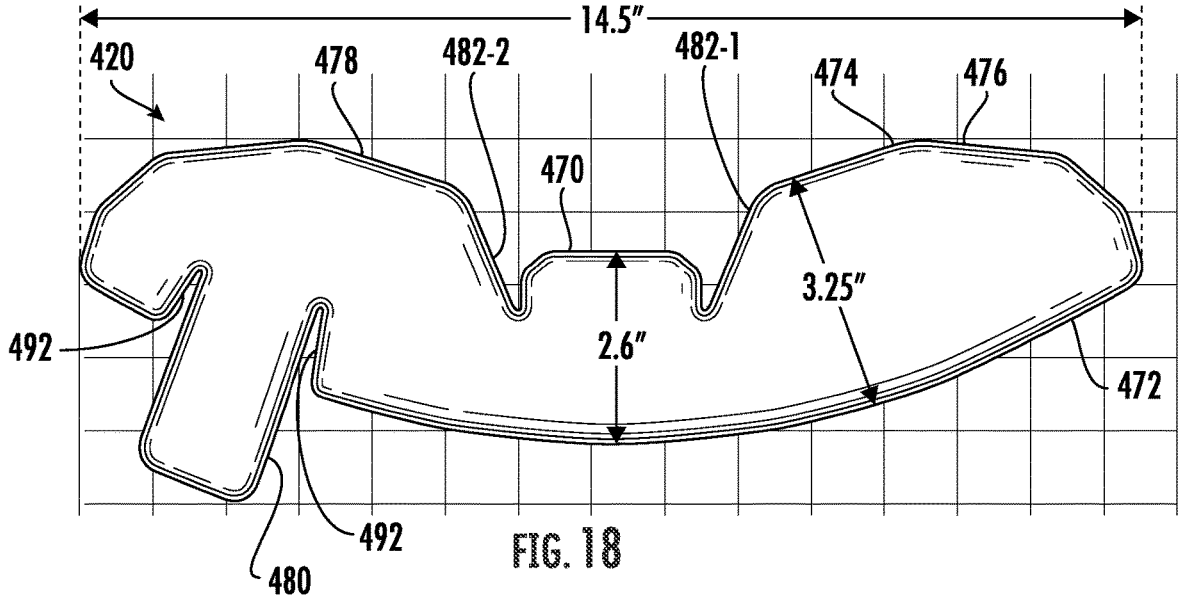
FIG. 18 is a top view of an example protective headwear liner of the system of FIG. 11 positioned against a measuring grid (in inches) and prior to shaping, hardening and customization of the liner.

As shown by FIGS. 14, 15 and 18, lower edge 472 comprises a pair of slits 492 extending on opposite sides of hanging portion 480. Slits 492 each have a height that is equal to or greater than the height of sweatband 452 slits 492 further assist in the insertion of liner 420 within the sleeve or channel formed by sweatband 452 and the extension of hanging portion 480. In implementations where liner 480 is not to be received within the channel formed by sweatband 452 and/or omit hanging portion 480, slits 492 may be omitted.

In some implementations, the U-shape of liner 420 may be preformed/pre-shaped so as to have its U-shape before receipt or use of the band by the person to wear the liner or before insertion into the headwear, such as the baseball cap. For example, liner may be manufactured and preformed prior to sale. The liner may be manufactured and preformed/pre-shaped prior to insertion into headwear, such as a baseball cap.

In some implementations, liner 420 may be molded and hardened into its shape while within a headwear, such as a baseball cap 410, while the cap 410 is being worn by a person or while the cap 410 is otherwise supported. As described above with respect to liners 20, 220, and 320, liner 420 may be molded and hardened while being pressed against a person's forehead and about sides of the person's head to customize liner 420 to the person's head. FIG. 18 illustrates such an example liner 420 prior to shaping/molding and hardening. FIG. 18 illustrates the example liner 420 overlying a measurement grid, wherein each block represents one square inch. FIG. 18 illustrates example liner 420 with one example shape and set of dimensions. In other examples, liner 420 may have other shapes are other dimensions.

In the example illustrated, liner 420 may have a construction similar to that of liner 20 or liner 320. For example, liner 420 may comprise an encasement 24 that surrounds and seals and enclosed moldable and hard about material 28. In the example illustrated, liner 420 additionally comprises an outer covering 326. The materials of encasement 24, material 28 and outer covering are described above, but wherein each is provided with the shapes and dimensions described above with respect liner 420.

FIG. 19 illustrates the insertion of the liner 420 of FIG. 18, prior to hardening of material 28, into baseball cap 410. During such insertion, lower edge 472 is inserted into lever channel formed by sweatband 452. Hanging portion 480 is wrapped about the lower edge 472 to form the upturned portion 486, with the channel 48 receiving lower edge 472. At such time, liner 420 is soft, pliable, and moldable.

Figure 20:
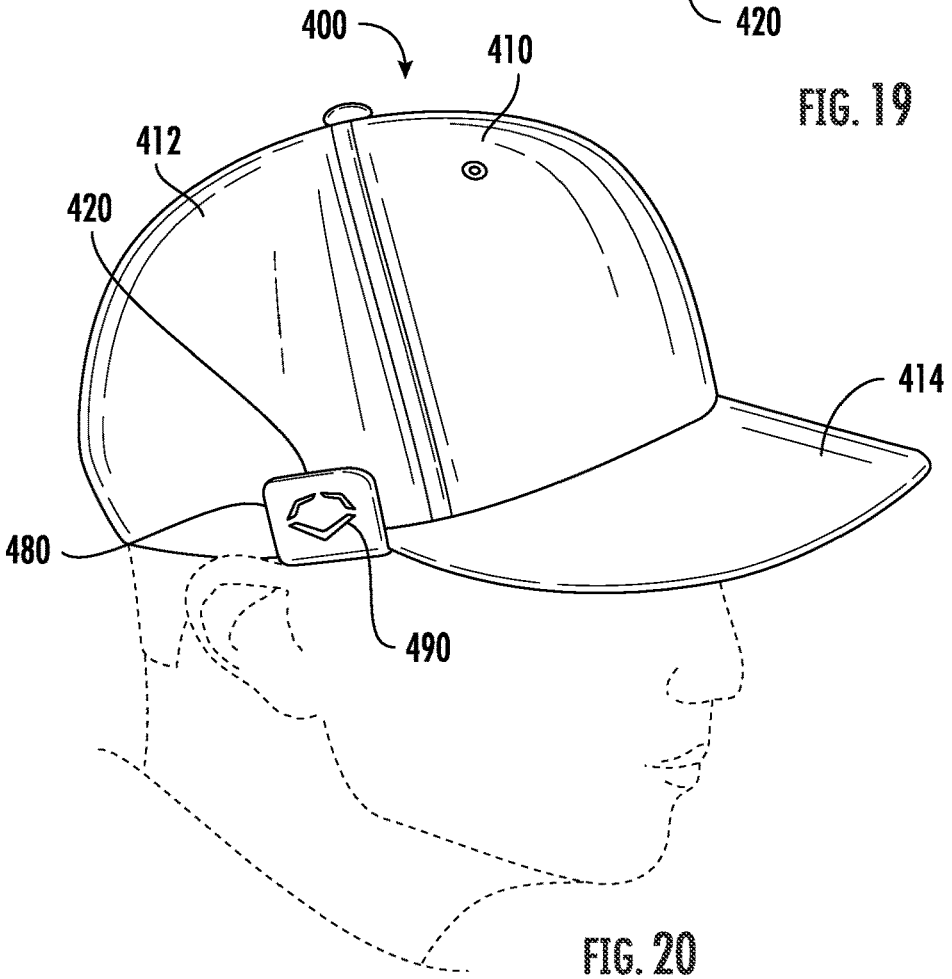
FIG. 20 is a perspective view of the protective headwear system of FIG. 11 worn by a person during customization or following hardening of the example protective headwear liner.

As shown by FIG. 20, the baseball cap 410, with the received liner 420 is then worn by the person for which liner 420 is being customized. The person positions cap 410 (with the receive liner 420) in a comfortable position on his or her head. While cap 410 is positioned on the person's head, the inserted line on the forms to a shape matching the shape of the person's head. The upturned portion 46 may be pressed against the temporal lobe of the person's head and against lower edge 472 of cap 410. While the cap is position on the person's head and while the upturned portion 46 is pressed against the outer sides of 410, the moldable and hardenable material 28 is hardened. Once hardened, material 28 retains its shape and likewise retains the shape of the encasement 24 and outer covering 326. Once hardened, material 28 retains liner 420 in a shape and configuration that is customized to the shape of the person's head and to the particular size and shape of cap 4101 being worn by the person. The custom shape better conforms to the unique size and shape of the head of the person wearing the baseball cap 410. As a result, the customized fit of liner 420 may enhance the ability of the liner 420 to retain its desired positioning on the head of the person. The customized fit of liner 420 may better conform to the player's head such that smaller, sleeker, and more attractive baseball may be used with the liner 420.

Because protective liner 420 is removably received within cap 410, liner 420 may be removed when the person desires where cap 410 without the protective liner 420. Liner 420 may also be removed for exchange with a differently sized or differently shaped liner 420 or may be removed for cleaning or repair of liner 420. Liner 420 may be removed for insertion into a different baseball cap 410. In yet other implementations, liner 420 may be non-removably or permanently secured to baseball cap 410 such as through the use of adhesives, stitching or the like.

Although the present disclosure has been described with reference to example implementations, workers skilled in the art will recognize that changes may be made in form and detail without departing from the scope of the claimed subject matter. For example, although different example implementations may have been described as including features providing benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. An apparatus comprising:

a protective headwear liner comprising:

an encasement; and a moldable and hardenable material within the encasement, wherein the encasement is deformable to a U-shape while containing the material prior to hardening of the material, the U-shape having a flat front and two flat sides corresponding to a front and sides of a person's head, respectively, wherein the two flat sides are joined to the flat front by curves and wherein the material is configured to retain the U-shape following hardening of the material, wherein the encasement comprises:

a lower edge;

a center front portion having a first maximum height above the lower edge;

a first wing portion extending from a first side of the center front portion, the first wing portion having a second maximum height above the lower edge and greater than the first maximum height;

a second wing portion extending from a second side of the center front portion, the second wing portion having the second maximum height above the lower edge; and an upper edge opposite the lower edge, wherein the upper edge comprises:

a first notch forming a first edge of the center front portion and a first edge of the first wing portion; and a second notch forming a second edge of the center front portion and a second edge of the second wing portion.

2. The apparatus of claim 1, wherein the moldable and hardenable material comprises a gel.

3. The apparatus of claim 1, wherein the protective headwear liner has a thickness of no greater than 0.7 inch.

4. The apparatus of claim 1, wherein the first wing portion comprises an upper edge opposite the lower edge and wherein the upper edge has a convex curvature extending from the first notch to a rearward most terminus of the first wing portion.

5. The apparatus of claim 1, wherein the U-shape extends in an arc having a circumferential length of at least 9 inches and no greater than 18 inches.

6. The apparatus of claim 1, wherein the encasement has a maximum height between the lower edge and the upper edge of no greater than 5 inches.

7. The apparatus of claim 1, wherein the protective headwear liner has a maximum thickness of no greater than 0.6 inch.

8. The apparatus of claim 1, wherein the protective headwear liner further comprises a retainer for releasably securing the protective headwear liner to a fabric baseball cap and wherein the retainer comprises a U-shaped upwardly facing channel for receiving a lower rim of the fabric baseball cap.

9. The apparatus of claim 1, wherein the two flat sides comprises a first flat side and a second flat side extending from the flat front, wherein the flat front and the two flat sides are coplanar prior to deformation to the U-shape, and wherein the encasement comprises a single continuous curved convex lower edge extending completely across and beneath the flat front, beneath the first flat side and beneath the second flat side.

10. The apparatus of claim 1, wherein the two flat sides comprises a first flat side and a second flat side, the first flat side extending from the flat front to a terminal end, wherein prior to deformation to the U-shape, the terminal end is coplanar with the flat front while the first flat side has an upper edge and a single continuous curved convex lower edge extending from the flat front to the terminal end.

11. The apparatus of claim 1, wherein the flat front has a width of at least 2 inches.

12. An apparatus comprising:

a protective headwear liner comprising:

an encasement; and a moldable and hardenable material within the encasement, wherein the encasement is deformable to a U-shape while containing the material prior to hardening of the material, the U-shape having a flat front and two flat sides corresponding to a front and sides of a person's head, respectively, wherein the two flat sides are joined to the flat front by curves and wherein the material is configured to retain the U-shape following hardening of the material, wherein the encasement comprises:

a lower edge;

a center front portion having a first height above the lower edge;

a first wing portion extending from a first side of the center front portion, the first wing portion having a second height above the lower edge and greater than the first height;

a second wing portion extending from a second side of the center front portion, the second wing portion having the second height above the lower edge; and a hanging portion projecting below the lower edge from the first wing portion, the hanging portion containing the moldable and hardenable material.

13. The apparatus of claim 12, wherein the hanging portion is planar and is configured to extend over a temporal lobe of a person wearing the protective headwear liner.

14. The apparatus of claim 12, wherein the hanging portion is deformable to a U-shape prior to hardening of the material, wherein the material is configured to retain the hanging portion in the U-shape following hardening of the material.

15. The apparatus of claim 14, wherein the U-shape of the hanging portion has an outermost face including indicia.

16. The apparatus of claim 12, wherein the encasement is deformable to the U-shape such that the center front portion vertically extends upwardly from the lower edge without bending about a horizontal axis.

17. The apparatus of claim 12, wherein the first wing portion comprises an upper edge opposite the lower edge and wherein the upper edge has a convex curvature extending from the center front portion to a rearward most terminus of the first wing portion.

18. An apparatus comprising:

a protective headwear liner for a cap having a lower edge, the liner having a lower liner edge and comprising:

an encasement; and a moldable and hardenable material within the encasement, wherein the encasement is deformable to a U-shape while containing the material prior to hardening of the material, the U-shape having a flat front and two flat sides corresponding to a front and sides of a person's head, respectively, wherein the two flat sides are joined to the flat front by curves and wherein the material is configured to retain the U-shape following hardening of the material, wherein the encasement comprises:

a lower edge;

a center front portion having an upper edge having a first maximum height above the lower edge;

a first wing portion extending from a first side of the center front portion to a first terminal end, wherein a midpoint of the first wing between and equidistantly spaced from the first terminal end and the center front portion has a second maximum height above the lower edge that is greater than the first maximum height; and a second wing portion extending from a second side of the center front portion to a second terminal end, wherein a midpoint of the second wing equidistantly between and spaced from the second terminal end and the center front portion has a third maximum height above the lower edge that is greater than the first maximum height and wherein the upper edge of the center front portion is concave and extends across a midpoint of the encasement equidistantly between and spaced from the first terminal end and the second terminal end.

19. The apparatus of claim 18, wherein the flat front has a width of at least 2 inches.

20. An apparatus comprising:

a protective headwear liner comprising:

an encasement;

a moldable and hardenable material within the encasement, wherein the encasement is deformable to a U-shape while containing the material prior to hardening of the material, the U-shape having a flat front and two flat sides corresponding to a front and sides of a person's head, respectively, wherein the two flat sides are joined to the flat front by curves and wherein the material is configured to retain the U-shape following hardening of the material; and a retainer for releasably securing the protective headwear liner to a fabric baseball cap and wherein the retainer comprises a U-shaped upwardly facing channel for receiving a lower rim of the fabric baseball cap.

* * * * *